United States Patent [19]

Coulombe

[11] 4,221,180

[45] Sep. 9, 1980

[54] COMPACT UPPER THREAD TENSION DEVICE

[75] Inventor: Lionel J. Coulombe, Matawan, N.J.

[73] Assignee: The Singer Company, Stamford, Conn.

[21] Appl. No.: 835,384

[22] Filed: Sep. 21, 1977

[51] Int. Cl.[3] ..... D05B 47/00

[52] U.S. Cl. ..... 112/254

[58] Field of Search ..... 112/254, 255, 59, 97; 226/195; 242/147 R, 150 R, 153, 154

[56] References Cited

U.S. PATENT DOCUMENTS

| | | | |
|---|---|---|---|
| 3,190,249 | 6/1965 | Gegauf | 112/254 |
| 3,366,083 | 1/1968 | Ketterer et al. | 112/254 |
| 3,472,190 | 10/1969 | Gegauf | 242/150 X |
| 3,557,731 | 1/1971 | Casas-Robert | 112/254 |
| 3,667,414 | 6/1972 | Illes et al. | 112/254 |
| 4,159,005 | 6/1979 | Jimenez et al. | 112/254 |

*Primary Examiner*—George H. Krizmanich
*Assistant Examiner*—Moshe I. Cohen
*Attorney, Agent, or Firm*—Edward P. Schmidt; Robert E. Smith; Edward L. Bell

[57] ABSTRACT

A modular upper thread tension device utilizing an end of a tension beam to press together at least a pair of opposed thread engaging discs, and a raised helix form track on an end cam to provide a variable pivot point for the beam, all the components of the tension device being arranged to provide a compact form of construction. The entire tension assembly is supported on a sheet metal bracket which is attachable to the sewing machine frame with the thread engaging discs thereof lying beneath a slot in a top cover. A bell crank is fulcrummed on a pin attached to the support bracket, and has one leg thereof pivotably attached to a first end of the tension beam, which is arranged to lie as an extension to that leg. A mandrel is supported, by lugs of the support bracket, parallel to the tension beam, and has one end thereof extending through the second leg of the bell crank. A compression spring supported on the mandrel bears against the second leg of the bell crank, and urges the first leg of the bell crank, and the first end of the tension beam to which it is pivotably connected, towards the mandrel. The raised helix form track on the end cam extends parallel to the tension beam and to the mandrel, and has at all times, a point on the raised helix track in abutment with a raised portion of the tension beam extending along the length thereof.

4 Claims, 4 Drawing Figures

COMPACT UPPER THREAD TENSION DEVICE

BACKGROUND OF THE INVENTION

This invention is in the field of sewing machine upper thread tension devices, more particularly, to thread tension devices wherein the thread tensioning discs are urged together by a leverage system having a pivot point, variable in order to adjust the force with which the tension discs are urged together.

There is a substantial body of prior art on upper thread tension devices, including the U.S. Pat. Nos. 3,557,731 of Casas-Robert and 3,190,249 of Gegauf, Jr. In particular, the latter patent of Gegauf, Jr. discloses a modular form of construction for a relatively complicated tension device of relatively large size.

There is also found in the prior art the U.S. Pat. Nos. 3,667,414 of Illes et al., and 3,366,083 of Ketterer et al., both of which refer to upper thread tension devices in which force is applied through a lever arrangement, and the force is made variable by a sliding fulcrum for the lever. In this particular prior art, the latter patent shows a relatively complicated arrangement for varying the fulcrum point of the lever, and the former patent discloses a somewhat less complex arrangement, but one utilizing considerably more space.

What is required is an upper thread tension device having none of the above drawbacks, i.e., an arrangement which is both simple and compact.

SUMMARY OF THE INVENTION

The above requirements are satisfied in an arrangement of an adjustable fulcrum tension, wherein the necessary components of an adjusting dial, compression spring and mandrel therefor, tension beam and fulcrum are arranged parallel to each other for the most compact package. Additionally, the variable fulcrum for the tension beam is implemented by a raised helix on an end cam parallel to, and rotated by, the adjusting dial. The entire tension assembly is supported on a supporting bracket which may be connected to the frame of a sewing machine in a position to align thread tension discs carried thereon with a thread slot in the sewing machine frame. A bell crank is carried on a pivot pin affixed to the support bracket, and has the end of the first leg thereof pivotably connected to a first end of a tension beam. The second end of the tension beam impinges on a pressure pin, part of a tension disc assembly, thereby to impart force to press together the thread tension discs. A mandrel is supported for axial adjustment by the support bracket parallel to the tension beam, the mandrel having an end thereof extending through an opening in the second leg of the bell crank. A compression spring is supported on the mandrel between the second leg of the bell crank and a stop on the mandrel, in order to urge the bell crank to exert a force on the first end of the tension beam. The support bracket further rotatably supports a shaft to which is affixed an adjusting dial for rotation parallel to the tension beam and the mandrel. On the end of the shaft adjacent the tension beam there is affixed a variable fulcrum implemented by the raised helix track on an end cam. The raised helix track on the end cam is of triangular cross-section, the apex of which impinges on a setout portion of the tension beam running the length thereof, in order to establish a fulcrum point. The dimensions of the helix of the end cam and of the setout portion of the tension beam are arranged to provide no more than a single point of contact at a given time, and to provide for a continuously variable fulcrum point extending from one end of the tension beam adjacent the first leg of the bell crank to a distance sufficiently along the length of the tension beam to provide the necessary force required by the tension disc assembly.

DESCRIPTION OF THE DRAWINGS

Having in mind the above and other objects that will be evident from an understanding of this disclosure, the invention comprises the devices, combinations and arrangement of parts as illustrated in the presently preferred embodiment of the invention which is hereinafter set forth in such detail as to enable those skilled in the art readily to understand the function, operation, construction and advantages of it when read in conjunction with the accompanying drawings in which:

Referring to FIG. 1, there is shown a sewing machine 10 into which the invention has been incorporated. The sewing machine 10 includes a work supporting bed 12, from one end of which there rises standard 14 which supports an arm 16 overhanging the bed and terminating in a head end 18 in which is supported an endwise reciprocating needle carrying bar 19 and presser bar 20 terminating in a presser foot 21. A pattern display module 23 is supported on the front of the arm 16, and a top thereof is covered by an arm top cover 25. The arm top cover 25 terminates short of a head end cover 26, there being a gap 27 between the two covers within which thread tension discs 35 are supported. The arm top cover 25 is formed with an aperture 28, spaced from the gap 27, through which a thread tension adjusting dial 37 extends.

Referring to FIG. 2 there is shown a thread tension module 40 including the thread tension adjusting dial 37 and thread tension discs 35. The thread tension components are supported on a sheet metal support bracket 42 which is affixed to suitable bosses within the arm 16 of the sewing machine 10 by screws 44.

Figure 1:
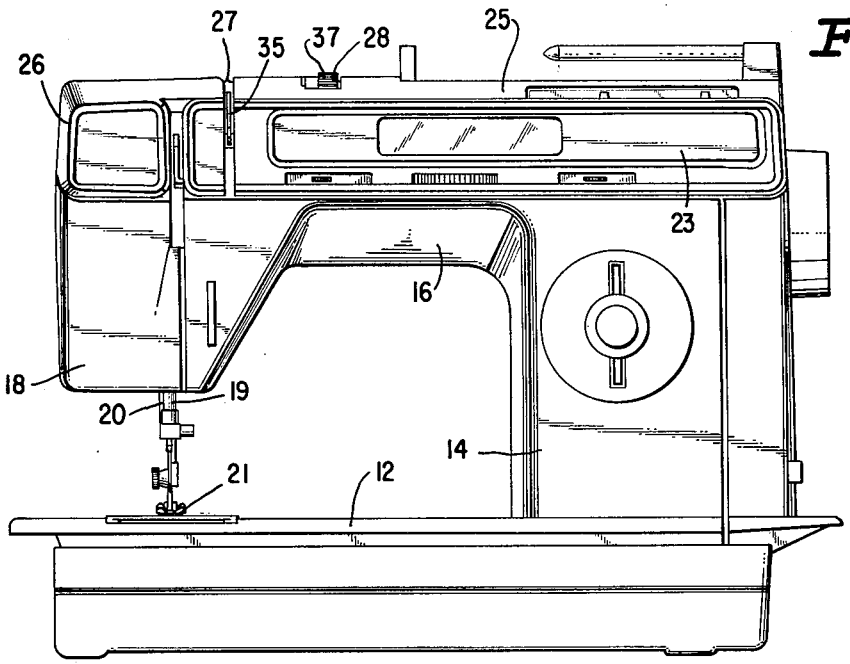
FIG. 1 is an elevation of a sewing machine in which the invention has been incorporated.

A bell crank 46 is pivotably supported on the support bracket 42 on a shouldered pivot pin 50 suitably attached to the support bracket. A first leg 47 of the bell crank 46 has a pin 52 pressed into its extremity, which pin is pivotably connected to the legs 53 of a "U"-shaped tension beam 54 straddling the first leg of the bell crank. A web 55 of the tension beam 54, joining the legs 53 thereof, is fashioned with a setout 56 extending over a major portion of the length of the tension beam. The web 55 of the tension beam 54 extends beyond the legs 53 opposite that end pivoted on pin 52, and impinges on a pressure pin 58, part of a tension disc assembly 60.

The tension disc assembly 60 is supported by an upstanding lug 62 of support bracket 42. A collar 63 is affixed to the upstanding lug 62, and receives a reduced diameter end of a hollow slotted post 65 on which the thread tension discs 35 are supported. The pressure pin 58 extends through the hollow interior of the slotted post 65, and is grooved (not shown) to receive the radially inwardly directed legs of washer 67, which are accommodated by the slots of the slotted post. Thus, any force imparted to the pressure pin 58 is transferred to the thread tension discs 35 by way of the washer 67. The upstanding lug 62 also supports a tension release lever 70 pivoted thereto on shouldered screw 71 fastened by nut 72. A vane 74 of the tension release lever 70 is urged upwardly, on rotation of the usual presser bar lifting lever for a sewing machine into a presser foot lift position, to rotate the tension release lever and have the wiper 75 thereof impinge on the pressure pin 58, forcing it rightwardly as viewed in FIG. 2, thereby to release tension imposed on sewing threads by the thread tension discs 35. A spring 73 is provided to urge the tension release lever 70 normally to a position with the wiper 75 disengaged from the pressure pin 58.

The source of the force applied to the pressure pin 58 is the compression spring 78. A mandrel 80 is supported parallel to the tension beam 54 so that one end thereof projects through an opening in the second leg 48 of the bell crank 46. The compression spring 78 is carried by the mandrel 80 between a washer 81 affixed to the mandrel and a friction washer 82 positioned between the compression spring and the second leg 48 of the bell crank 46. The mandrel 80 is carried by ears 87, 88 of upstanding lug 86 of the support bracket 42. A threaded end 83 of the mandrel 80 engages with an internally threaded hole in the ear 87 to enable axial positioning of the mandrel so that the compression of the spring 78 may be adjusted. An adjusted position of the mandrel 80 may be locked by means of nut 89.

The upstanding lug 86 of the support bracket 42 also provides half of the support for the rotatable shaft 94, which obtains the other half of its support from upstanding lug 91 also fashioned as part of support bracket 42. The thread tension adjusting dial 37 is affixed to the shaft 94 to permit rotation thereof and of the helix track end cam 96 affixed thereto. The shaft 94 is arranged substantially normal to the tension beam 54, and the end cam 96 is swung by rotation of the adjusting dial 37 in a plane parallel to the tension beam. The helix track 97 on the end cam 96 (See FIG. 4) is triangular in cross-section, and an apex 98 thereof impinges on the setout 56 of the web 55 of the tension beam 54, at a selectively variable point depending upon rotational position of the adjusting dial 37. The length of the setout 56 of the tension beam 54 is arranged with respect to the helix track 97 so that there may be only a single point of contact between the end cam 96 and the tension beam 54. The upstanding lug 91 of the support bracket 42 is straddled by a pair of collars 93 supported on the shaft 94, and affixed thereto by set screws 95 protruding therefrom which may be arranged to interfere with tabs 92, formed as part of the upstanding lug, to limit rotation of the adjusting dial 37 to the extreme positions of contact of the apex 98 of the helix track 97 with the setout 56 on the tension beam 54.

The operation of the device may now be described. The compression spring 78 tends to urge the bell crank 46 in a counterclockwise direction as viewed in FIG. 2. Through pin 52 in the first leg 47 of the bell crank 46, a clockwise moment of the tension beam 54 about the pivot point provided by the end cam 96 is incurred. This clockwise moment of the tension beam 54 is opposed by the force exerted by the pressure pin 58 in opposition to that exerted by the web 55 of the tension beam thereupon. By means of the inwardly directed legs (not shown) of the washer 67 engaging with a groove (not shown) in the pressure pin 58, the force exerted by the pressure pin is transferred to the thread tension discs 35, thereby to obtain an upper thread tension or resistance to thread motion through the tension discs. Where the vane 74 of the tension release lever 70 is elevated by elevation of the presser foot from a work material, the wiper 75 engages with the end of the pressure pin 58, urging the pressure pin in a rightwardly direction as viewed in FIG. 2 to release the tension imposed on the thread tension discs 35. In the position shown in FIG. 2, the end cam 96 is shown rotated to that position where the greatest amount of force is transferred to the pressure pin 58 of the tension assembly 60. If the tension adjusting dial 37 is rotated downwardly to obtain connection between the apex 98 of the helix track 97 and the setout 56 of the tension beam 54 farthest from the center line of the shaft 94, by design this connection is just opposite the pin 52, i.e., in a position where the end cam 96 takes up the entire thrust of the compression spring 78 and no force is transferred to the pressure pin 58. In the position of the end cam 96 shown in FIG. 2, the resistance of motion of the sewing thread through the thread tension discs 35 may be adjusted by axially repositioning of the mandrel 80 by means of the threaded connection thereof with the ear 87 of the upstanding lug 86, thereby to change the compression of the compression spring 78.

Figure 2:
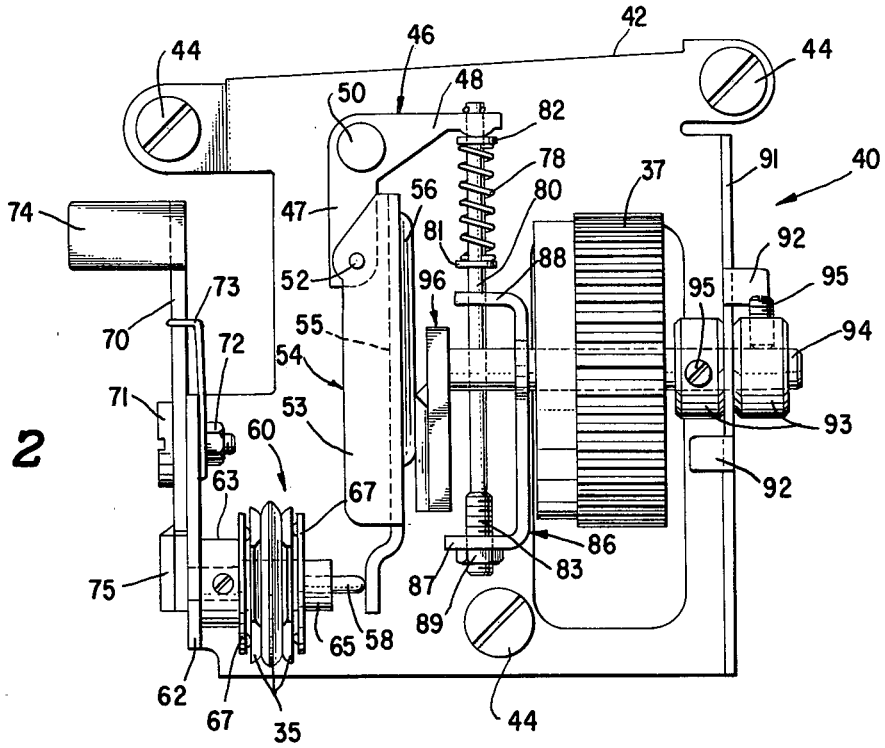
FIG. 2 is an enlarged top plan view of the tension module of the invention.
Figure 3:
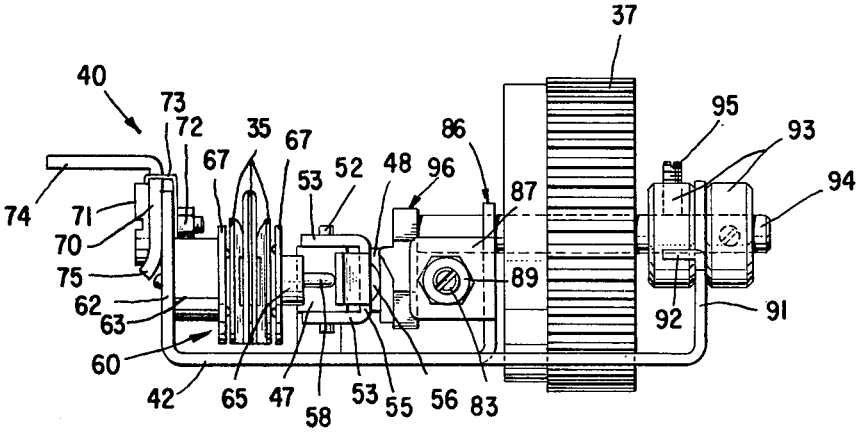
FIG. 3 is a front elevation of the module shown in FIG. 2.
Figure 4:
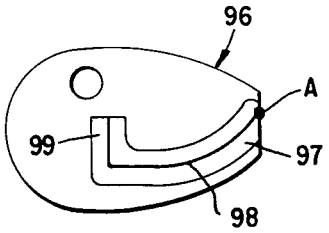
FIG. 4 is an elevation of the end cam and raised helix thereon.

It will be apparent to those skilled in the art that the helix track 97 of the end cam 96 may be tailored to prefer, for example, maximum tension generation by the tension disc assembly 60; or to increase the maximum tension available by shifting the point of contact of the apex 98 and the setout 56 of the tension beam 54 downwardly from that shown in FIG. 2. In the end cam 96, the area 99 of the helix track 97, shown in FIG. 4, is responsible for generation of the maximum tension, and may be shifted to increase or decrease the maximum tension by a rightward or leftward movement, respectively, of the area 99 from the position shown in FIG. 4. Thus, the helix track 97 of the end cam 96 begins at point A of FIG. 4 where the apex 98 of the track is aligned opposite the pin 52 transferring force to the tension beam 54, in order to obtain zero force on the pressure pin 58. The helix track 97 may wind inwardly to the area 99 thereof required for maximum tension in a curved form designed ideally to cross the axis of the setout 56 of the tension beam 54 normal thereto for greatest definition of the fulcrum point. Of course, other modifications may be made to the helix track 97 in order to obtain any specific characteristics desired. In an appropriate circumstance, the track may have an apex which is a straight line, spaced from the shaft 94.

The tension beam 54, face cam 96, mandrel 80, compression spring 78 and tension adjusting dial 37 have all been arranged in parallel to obtain a high degree of compaction. Other modifications will suggest themselves to those skilled in the art, such as replacing the compression spring 78 and mandrel 80 with a leaf spring extension to the second leg 48 of the bell crank 46, or by some other arrangement of a coil spring impinging on a rigid extension of the second leg 48. However, it is apparent that the greatest compaction is achieved by supporting these components as shown in the drawings and as explained in this disclosure.

Having thus set forth the nature of the invention what is sought to be claimed is:

1. A thread tensioning arrangement for a sewing machine having a frame, said tensioning arrangement having at least two discs arranged in contiguity with each other and adapted to receive a thread therebetween for imparting resistance to movement of the thread, means for transferring force normal to said discs to press said discs together, and a fulcrum tension device comprising:

a tension beam having first and second ends, said second end being operatively connected to said force transferring means; means connected to said first end of said tension beam for imparting a force thereto; and variable means for selectively variably pivoting said tension beam for selectively variable transfer of moment thereby, said variable pivoting means being rotatable in a plane parallel to said tension beam and having a point of contact selectively variable on rotation thereof with said tension beam in opposition to said force imparting means.

2. A thread tension arrangement as claimed in claim 1 wherein said tension beam further comprises a setout extending along a portion of the length of said tension beam; and said variable pivoting means further comprises a plate having a raised track of substantially triangular cross-section, the apex of which is used as a source of fulcra for abutting said setout of said tension beam.

3. A thread tension arrangement as claimed in claim 2 wherein said force imparting means further comprises:

a bell crank supported for pivotal movement by said sewing machine frame, a first leg of said bell crank pivotably connected to said first end of said tension beam, a second leg of said bell crank having an opening in an end thereof; a mandrel supported by said sewing machine frame parallel to said tension beam and said variable pivoting means, an end of said mandrel extending through said opening in said second leg of said bell crank and a portion inward of said end formed with a stop; a resilient member supported by said mandrel and contrained between said stop and said second leg of said bell crank; whereby the force exerted by said constrained resilient member upon said second leg of said bell crank is transferred by way of said first leg of said bell crank to said first end of said tension beam.

4. A thread tension arrangement as claimed in claim 3, wherein said apex of said raised track on said plate of said variable pivoting means forms a helix, and wherein selective rotation of said variable pivoting means will selectively bring one end point of said helix in abutment with said setout of said tension beam alligned with said force imparting means, whereby no force is transferred by said tension beam to said force transferring means.

* * * * *